United States Patent [19]

Ohnuma et al.

[11] Patent Number: 4,838,828

[45] Date of Patent: Jun. 13, 1989

[54] ENDLESS RAIL FOR RUNNING TOY

[75] Inventors: Nobuyoshi Ohnuma; Akio Ueda, both of Mibu, Japan

[73] Assignee: Toybox Corporation, Tokyo, Japan

[21] Appl. No.: 199,348

[22] Filed: May 26, 1988

[30] Foreign Application Priority Data

Aug. 12, 1987 [JP] Japan ..... 62-122602[U]

[51] Int. Cl.[4] ..... A63H 18/00

[52] U.S. Cl. ..... 446/446; 446/121; 238/10 F

[58] Field of Search ..... 446/446, 444, 445, 447, 446/120, 121, 455; 238/10 E, 10 F, 10 A; 273/86 B

[56] References Cited

U.S. PATENT DOCUMENTS

| | | | |
|---|---|---|---|
| 2,794,296 | 6/1957 | Fields | 446/444 |
| 4,564,197 | 1/1986 | Lambert et al. | 273/86 |

FOREIGN PATENT DOCUMENTS

| | | | |
|---|---|---|---|
| 1352734 | 12/1964 | France | 446/120 |
| 50-12480 | 4/1975 | Japan . | |
| 678294 | 9/1952 | United Kingdom | 446/446 |
| 916069 | 1/1963 | United Kingdom . | |
| 1110341 | 4/1968 | United Kingdom . | |
| 2187651 | 9/1987 | United Kingdom | 446/444 |

*Primary Examiner*—Mickey Yu

*Attorney, Agent, or Firm*—Staas & Halsey

[57] ABSTRACT

An endless rail for a running toy is described. The rail includes a plurality of block bodies, each having a guide groove formed on a top surface thereof. Each block body is in the shape of an alphabet letter or symbol. Each guide groove is open to at least one end surface of the block body. A female fitting portion and a male fitting portion are formed adjacent each opening of the guide groove to connect block bodies together and communicate the guide grooves. The running toy is provided with a guide pin fitted into the communicated grooves.

6 Claims, 4 Drawing Sheets

ENDLESS RAIL FOR RUNNING TOY

BACKGROUND OF THE INVENTION

This invention relates to an endless rail for a running toy and, more particularly, to a plurality of connectable blocks, each in the shape of, e.g. a letter of the alphabet, and having a guide groove formed on a top surface thereof which form an endless rail for a running toy when the blocks are connected.

A block is known wherein a guide groove is formed on a surface thereof, or guide grooves are formed on all surfaces thereof. This block can be connected to similar blocks for creating an endless rail for a running toy. However, each block is intentionally the same shape so that they can be used in other, conventional manners, e.g. stacking. As a result of the single shape, the amusement value of these blocks in forming an endless rail is limited.

SUMMARY OF THE INVENTION

Accordingly, it is an object of the present invention to provide an endless rail for a running toy including a number of differently shaped, connectable blocks having guide grooves, thereby increasing the amusement value of this type of toy.

To achieve the foregoing and other objects of the present invention and in accordance with the purposes of the invention, there is provided a plurality of block bodies, each having the shape of an alphabet letter or other symbol and a guide groove formed on a top surface thereof. Some of the plurality of block bodies have a single guide groove formed in a ring or curved shape extending from an end surface of the block body to the same end surface. The remaining block bodies include at least one guide groove extending from one end surface to an opposite end surface. An end portion of each guide groove is opened to the end surface of the block body. A female fitting portion and a male fitting portion are formed adjacent the end portion of the guide groove on an end surface of the block body. The male and female fitting portions are connectable, thereby connecting adjacent block bodies and communicating the guide grooves of the connected block bodies. The connected guide grooves of the block bodies form an endless rail for a running toy.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

BRIEF DESCRIPTION OF THE PREFERRED EMBODIMENTS

The preferred embodiments of the present invention will now be described with reference to FIGS. 1–7.

Figure 1:
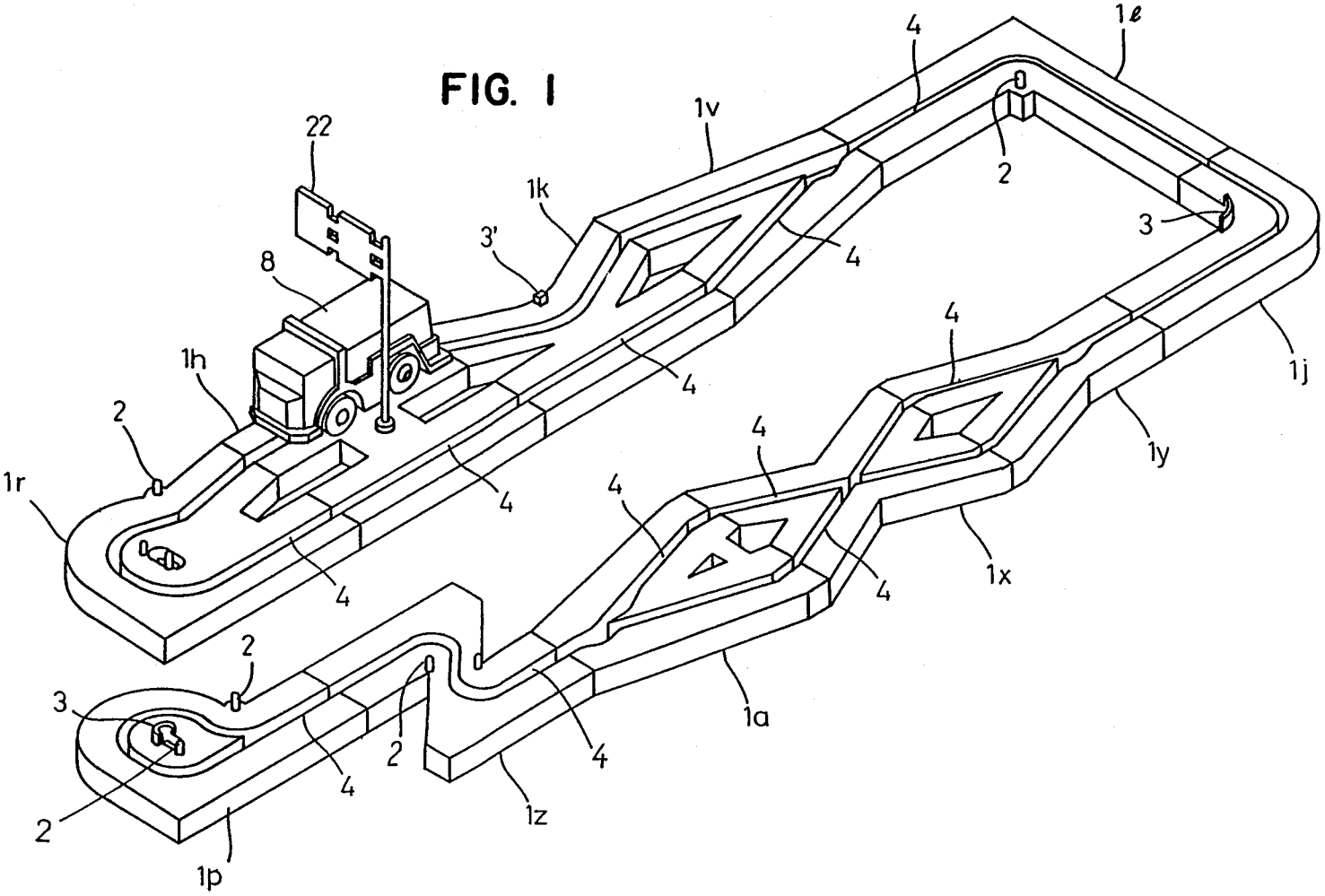
FIG. 1 is a perspective view showing the block bodies according to the present invention connected to form an endless rail for a running toy.

FIG. 1 illustrates a plurality of connected block bodies 1, each having the shape of an alphabet letter. The block bodies 1 are preferably made of synthetic resin to have a frame shape with an open bottom. Each block body 1 has a guide groove 4 formed in a top surface thereof. For convenience in referring to each different type of block body 1, the actual alphabet letter will be referred to, such as "1*a*".

Block bodies 1*z*, 1*a*, 1*x*, 1*y*, 1*j*, 1*l*, 1*v*, 1*k* and 1*h* are called "running through" type block bodies. As seen, in some of these block bodies 1, the guide groove 4 is a single, longitudinally central, groove open to and extending from one end surface of the block body 1 to an opposite end surface, e.g. 1*j*, 1*z* and 1*l*. In other block bodies 1, a single guide groove 4 opens to and extends from one end surface, branches, and opens at two areas on an opposite end surface, e.g. 1*a*, 1*y*, 1*v*. Still other block bodies 1 include a guide groove 4 with two openings at one end surface and two openings at an opposite end surface, with or without the guide groove 4 intersecting, e.g. compare 1*x* with 1*k* and 1*h*.

Figure 2:
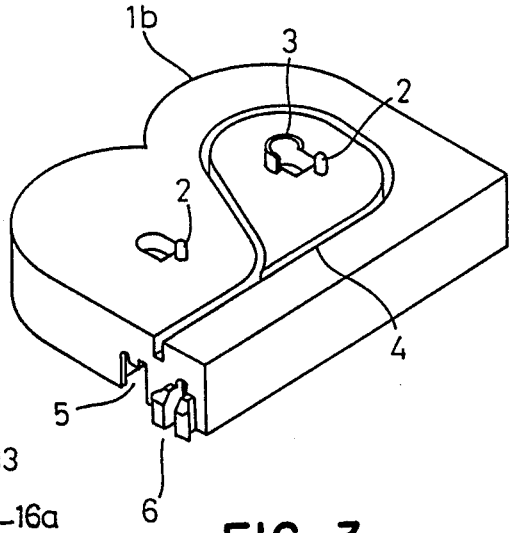
FIG. 2 is a perspective view depicting a single block body according to the present invention.

Contrary to the "running through" block bodies 1*z* through 1*h* described above, each block body 1*p*, 1*r*, 1*b* shown in FIGS. 1 and 2 is a "turn type" block body 1. The block body 1*r* is provided with a single, curved guide groove 4 opening twice on the same end surface of the block body 1. Block bodies 1*p* and 1*b* have a guide groove 4 opening once on an end surface and including a ring-like portion. By connecting the "running through" block bodies, and the "turn" type block bodies, the respective guide grooves 4 are communicably connected, so that an endless rail can be constructed. The means for connection is described below.

At an end surface of a block body 1, a female fitting portion 5 and a male fitting portion 6 are formed near the opening of the guide groove 4. The female fitting portion 5 includes an opening formed in the end surface of the block body 1, whereas the male fitting portion 6 includes a projection 7 formed on the same end surface of the block body 1, on the other side of the guide groove 4.

Figure 5:
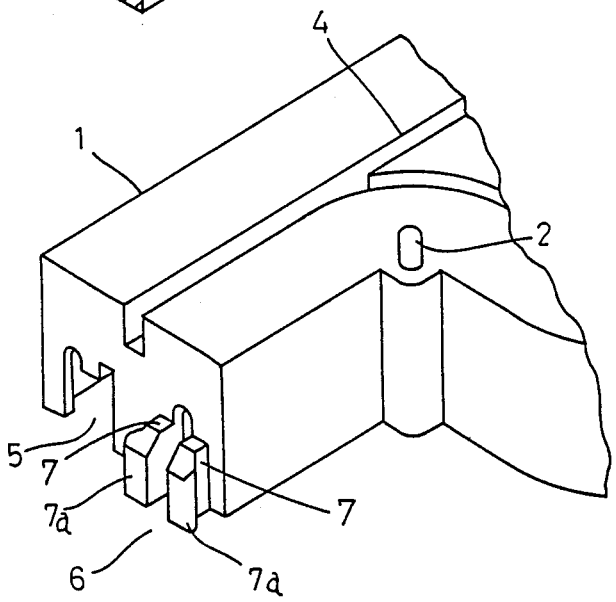
FIG. 5 is a perspective view showing the male and female fitting portions on an end surface of a block body.

As best shown in FIG. 5, the projection 7 includes a pair of engagement flanges 7*a*, projecting sideways. These engagement flanges 7*a* engage elastically to the side wall edges of the opening of the female fitting portion 5. That is, the engagement flanges 7*a* of one block body 1 can be engaged by an interference fit with the opening of the female fitting portion 5 in another block body 1. When the female fitting portion 5 and the male fitting portion 6 of a block body 1 are fitted to corresponding male and female fitting portions 5, 6 of another block body 1, the guide grooves 4 are communicated to form the endless rail for a running toy.

On the top surface of some of the block bodies 1, e.g. 1z, **1*l* and 1*j*, projections 2, 3 and/or 3' are formed inside and outside the guide grooves 4 to abut and easily change the running direction of the running toy. Further, on a suitable place on the top surface of one or more block bodies 1, there is formed at least one fitting hole into which a traffic sign or other indicia 22** can be positioned.

Figure 7:
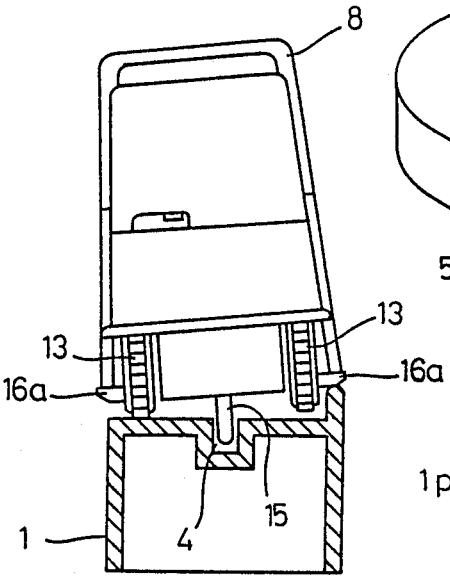
FIG. 7 is a partial, cross-sectional view of the running toy shown in FIG. 6 moving along a guide groove formed in the top surface of a block body.
Figure 3:
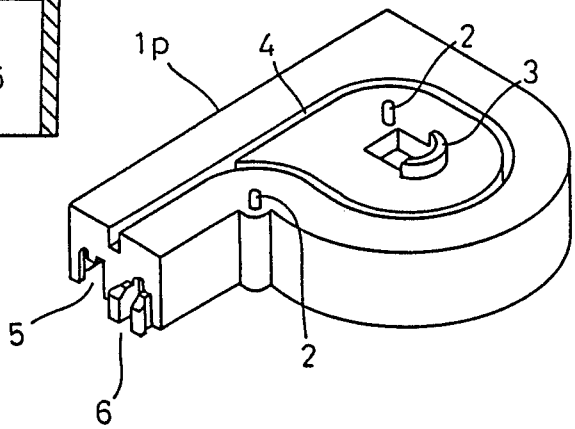
FIG. 3 is a perspective view depicting another block body.
Figure 4:
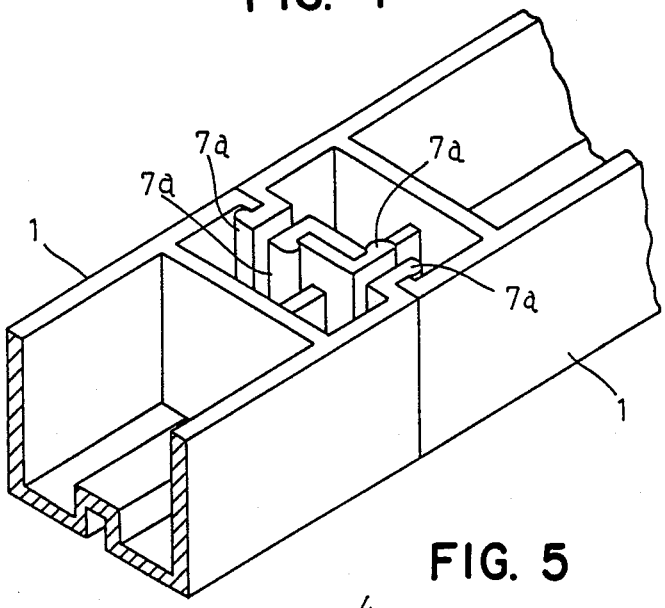
FIG. 4 is a perspective view showing connection of pairs of male and female fitting portions on adjacent block bodies.
Figure 6:
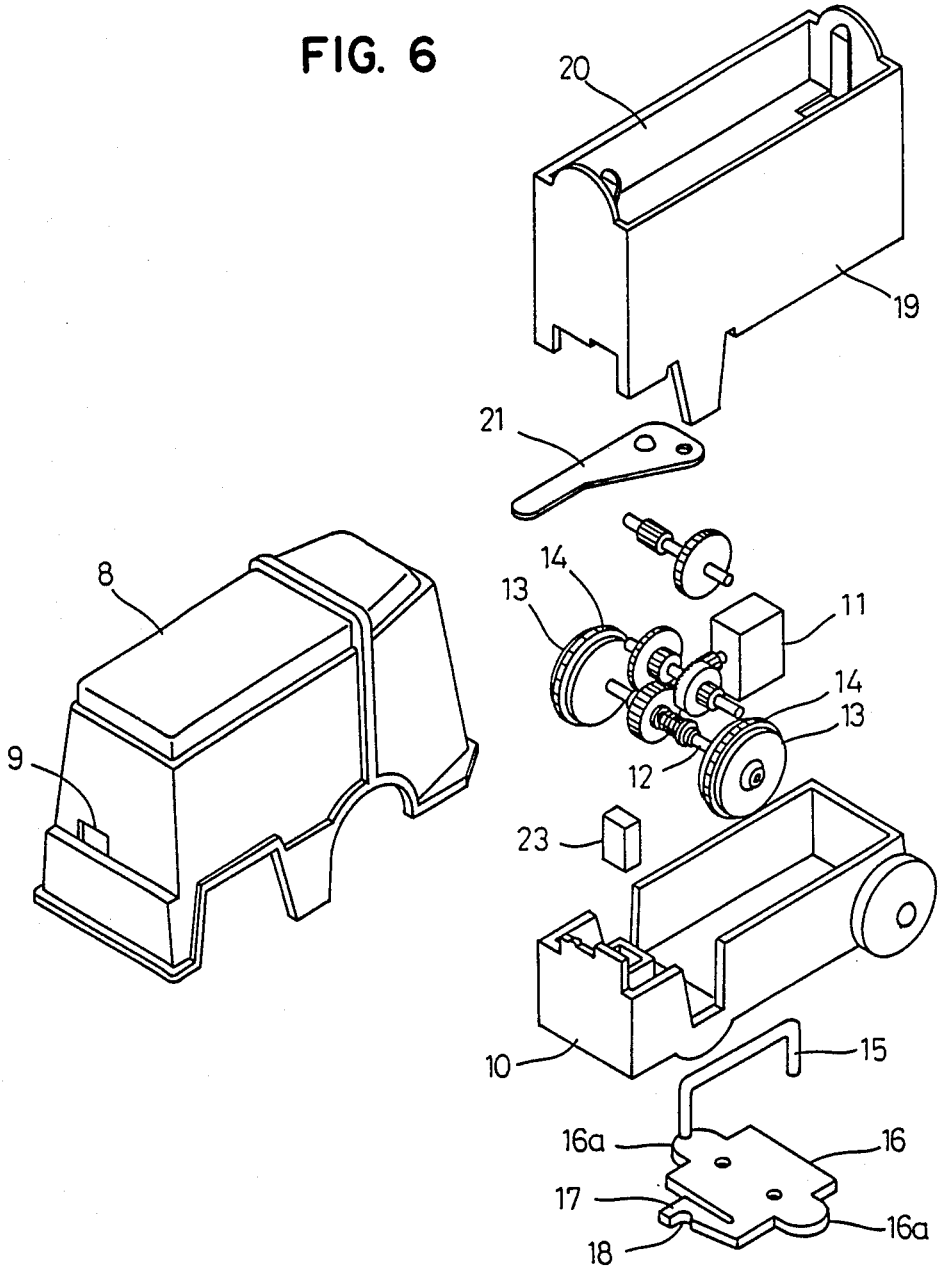
FIG. 6 is a perspective, exploded view of a running toy according to the present invention.

FIGS. 6 and 7 illustrate the running toy which includes generally a drive mechanism 11–14, a frame 19, a chassis 10 and a body 8. The drive mechanism includes a gear train and a motor 11. A portion 20 on top of the frame 19 contains a battery (not shown) for powering the motor 11. A through hole 9 is formed at the rear of the body 8. A switch 21, for actuating the motor 11, projects from the body 8. The gear train transfers the drive force from the motor 11 and includes a drive shaft 12, both ends of which have drive wheels 13 fitted thereto. On the outer periphery of each drive wheel 13, rubber tires or gripping members 14 are attached.

The chassis 10 is attached to the frame 19. A guide pin 15 having two bent, free ends is rotatably attached to the chassis 10 through a pressing plate 16. When the guide pine 15 is rotated, one of the bent, free ends fits a cut-out portion 18 of an elastic plate 17 projecting from the pressing plate 16.

The free ends of the guide pin 15 fit into the guide grooves 4 of the block bodies 1 to guide and stabilize the running toy 8 during operation. Projections **16*a* extend from both sides of the pressing plate 16 and abut the projections 2, 3, 3' while the running toy runs along a curved area of the guide grooves 4**, resulting in easy direction change of the running toy.

A weight 23 is placed near the driving shaft 12 of the chassis 10, so that the driving wheels 13 of the relatively light and small running toy firmly grip the top surface of each block body 1.

In the preferred embodiment described above, the appearance of each block body 1 is an alphabet letter. As a result, conventional letter playing games and the like can also be played by children using this toy. Further, each block body 1 may instead be a number, e.g. 1 through 10, and/or some other symbol such as addition, subtraction, multiplication, and division signs, to be used in other games.

As described above, the present invention provides a toy including blocks of different shapes such as letters or symbols each having a guide groove on the top surface thereof. A "running through" block body 1 includes a guide groove 4 open at opposite end surfaces. A "turn type" block body 1 has a ring-like or curved guide groove 4 provided with a common exit and entrance. The block bodies 1 can be attached to each other to form an endless rail. Also, respective block bodies 1 can be used for letter and number playing games like conventional blocks, thereby yielding a high amusement value for a single toy.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. An endless rail for a running toy, comprising:

(a) a first plurality of block bodies, each configured in a different shape and including a guide groove formed on a top surface thereof opening to and extending from one end surface to another end surface of said block body;

(b) a second plurality of block bodies, each configured in a different shape and including a guide groove formed on a top surface thereof opening to and extending form one end surface to the same end surface of said block body, wherein each of the first and second pluralities of block bodies is configured as an alphabet letter;

(c) means formed on each block body for connecting the first and second pluralities of block bodies such that the guide grooves are connected to form an endless rail; and (d) a single toy for running along the endless rail by cooperating with the connected guide grooves.

2. The rail as recited in claim 1, wherein the running toy is provided with a guide pin fitted into said connected guide grooves.

3. The rail as recited in claim 1, wherein the connecting means comprises:

(a) a female fitting portion and a male fitting portion formed on each end surface of the first plurality of block bodies; and (b) a female fitting portion and a male fitting portion formed on said end surface of each of said second plurality of block bodies, wherein each female fitting portion includes an opening and each male fitting portion includes a pair of flanges extending outwardly.

4. The rail as recited in claim 1, further comprising:

(e) a stationary projection formed on the top surface of at least one of the block bodies for engaging and changing the direction of the running toy.

5. The rail as recited in claim 4, further comprising:

(f) projections formed on the running toy for engaging the projections formed on the top surface of the at least one of the block bodies.

6. The rail as recited in claim 1, further comprising:

(e) a hole formed in the top surface of at least one of the block bodies; and (f) a projecting element including indicia received by the hole.

* * * * *